United States Patent [19]

Muhlbach

[11] 4,366,589

[45] Jan. 4, 1983

[54] CEMENT PRESS FOR CEMENT ATTACHING OUTSOLES TO LASTED FOOTWEAR

[75] Inventor: Anton Muhlbach, Frankfurt am Main-Sossenheim, Fed. Rep. of Germany

[73] Assignee: USM Corporation, Farmington, Conn.

[21] Appl. No.: 232,721

[22] Filed: Feb. 9, 1981

Related U.S. Application Data

[63] Continuation-in-part of Ser. No. 114,120, Jan. 21, 1980.

[51] Int. Cl.[3] ..... A43D 63/00

[52] U.S. Cl. ..... 12/16.4

[58] Field of Search ..... 12/16.1, 16.2, 16.3, 12/16.4

[56] References Cited

U.S. PATENT DOCUMENTS 3,550,175 12/1970 Downing et al. ..... 12/16.4

4,017,929 4/1977 Capcano ..... 12/16.4

*Primary Examiner*—Patrick D. Lawson

*Attorney, Agent, or Firm*—Donald N. Halgren

[57] ABSTRACT

A cementing press for cement attaching outsoles to lasted footwear from their toe up to the lower end of the heel breast by using a counter support applying pressure to the waist region. A heel support takes up the pressure exerted to the heel breast during cement attaching. The heel support is arranged on a lever pivoted around a fulcrum running transversely to the longitudinal direction of the shoe towards the heel.

3 Claims, 2 Drawing Figures

2
5
7
9
11
12
14
15
16
17
18
20
21
22
23
24
25
26
27
28
29
30
31
32
33
34
35
37
38
40
40
42
43
44
45
46
47
48
50
51
52
53
54

CEMENT PRESS FOR CEMENT ATTACHING OUTSOLES TO LASTED FOOTWEAR

RELATION TO OTHER CASES

This application is a continuation-in-part of our copending application, Ser. No. 114,120, filed Jan. 21, 1980.

BACKGROUND OF THE INVENTION (1) Field of the Invention

This invention relates to a cementing press for attaching outsoles to lasted footwear from their toe up to the lower end of the heel breast by using a counter support applying pressure in the waist region, whereby a heel support takes up the pressure exerted to the heel breast during cement attaching, which heel support is arranged on a lever pivoted around a fulcrum running transversely to the longitudinal direction of the shoe towards the heel.

(2) Prior Art

A basic cementing press is shown in German Patent Application No. DE-AS 1 212 445. On this known cementing press a separate attachment is necessary that is actuated by means of pressure for swinging a lever with a heel support against the heel.

SUMMARY OF THE INVENTION

According to the present invention the cementing press can be adapted to enable footwear to be processed in which the heel breast is not subjected to cement attaching, but the heel is supported by a heel abutment, whereby costs can be saved. According to the invention, this is achieved by a lifting mechanism in which a heel abutment is provided with a catch that engages an inclined slot in the lever. Thus with the lifting of the heel abutment, the lever together with the heel support is drawn up to the heel.

With the cementing press adapted according to the present invention, the lifting mechanism of the heel abutment is thus ingeniously used both for abutment and for drawing up the heel support, since the lifting motion is transformed into a swinging motion by means of the catch and the slot in the lever carrying the heel support. In this way, one single member actuated by means of pressure is adequate for the initiation of the lifting and of the swinging motion.

Appropriately, the catch is designed as a cylindrical pin, which is inserted transversely through a fork projecting from the lifting mechanism, in which the fork enters the lever with the slot. Being of this design, the pin (supported at both its ends) can withstand considerable forces and thus can exert a corresponding pressure onto the heel support via the lever and the slot.

It is advantageous to arrange the catch to be optionally insertable. In this case, the cementing press can be used either with the heel support or without it. When processing footwear which does not require the outsole to be attached to the heel breast, then the heel support is not required and the catch may be withdrawn. The cementing press in this mode is normally subjected to a different kind of control as to actuation of its counter support. A signaler is provided which is operated in the rearward position of the lever and the withdrawn catch.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
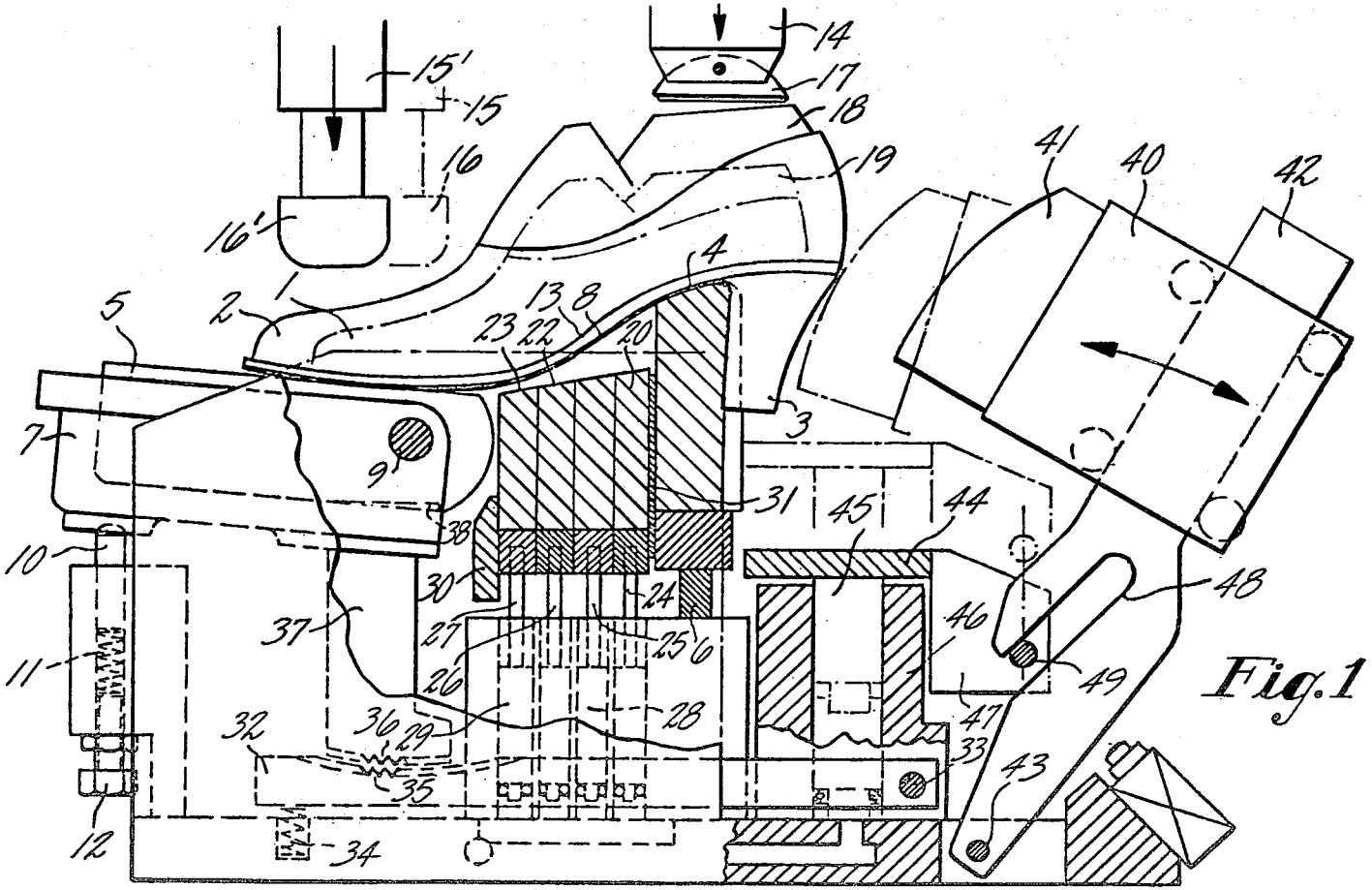
FIG. 1 shows the cementing press with the catch inserted and with a shoe, on which the outsole is to be attached from the toe up to the lower end of the heel breast.

FIG. 1 shows a lady's shoe 1, on which an outsole 8 is to be attached from the toe of the shoe up to the lower end of the breast of the heel 3. The shoe 1 is placed at the one end onto a support 4 and at the other end onto the cushion 5. The support 4 thereby supports the shoe 1 directly in front of its heel 3. The support 4 can be set in a known way by means of a bolt 6 to any height required. In this way, the cementing press is adapted individually to the shape of the type of shoe being processed. The shoe 1 lies in its toe and ball region upon the cushion 5, which is carried by a rocker assembly 7. The cushion 5 consists of rubber and therefore possesses the required yieldingness for the adaptation to the outsole 8. The rocker assembly 7 is pivoted by means of a fulcrum 9. At the side away from the shoe 1 the rocker assembly 7 in its rest position is supported by a plunger 10 which applies pressure onto an adjusting screw 12 via a spring 11. By means of this adjusting screw 12 the plunger 10 can be set to any desirable height. When bedding pressure is exerted against the cushion 5, the spring 11 and the rocker assembly 7 can twist downwardly a little at its end away from the shoe 1.

In order to expose the shoe 1 to the bedding pressure required for attaching the outsole 8, a pair of presser members 14 and 15 are provided. According to the length of the shoe to be processed, the presser member 15 is adjustably arranged in longitudinal direction of shoe 1, which is not outlined in the illustration for reasons of clarity. The presser member 15has a pad 16 at its lower end which presses onto the upper leather of the shoe 1 to be processed. The use of the pad 16 eliminates any danger of the upper leather of shoe 1 becoming damaged when pressure is exerted. The presser member 14 presses onto the last 18 via a foot 17.

The shoe to be processed is placed initially onto the support 4 and onto the cushion 5 as outlined above, whereby the shoe 1 takes up the position shown in FIG. 1. Then the whole of the mechanism below the presser members 14 and 15 is moved upwardly so that the shoe 1 with its upper leather is seating against the pad 16, and the last 18 contacts the foot 17 of the presser member 14. Further upward movement of the mechanism then causes the bedding pressure to be initiated that is required for attaching the outsole 8. The cementing press has control in a known way by which a signal is given when a certain relatively low pressure is attained. When the signal is given, the pads 20 to 23 arranged between the support 4 and the cushion 5 begin to move upwardly. The pads 20 to 23 are arranged directly side by side and are operated by plungers 24 to 27 via hydraulic pistons, each plunger 24 to 27 being provided with its own hydraulic piston. The pads 20 to 23 arranged side by side are supported at the one side by the guide 30 and at the other side by a plate 31. These construction elements are mounted to the frame of the cementing press in a conventional way.

An arm 37 is attached solidly to the rocker assembly 7 which consequently responds to any swinging movement of the rocker assembly 7 effected around its fulcrum 9. The arm 37 is provided with serrations 36 for engagement with an arrangement of counter serrations 35 in a rack 32. The rack 32 is pivoted at its right-hand end around a fulcrum 33 and is pushed upwardly at its left-hand end by a compression spring 34. The rack 32, however, is held initially in the position as shown in FIG. 1 by a conventional means until the pads 20 to 23 are raised. Raising of the pads releases the interlock on the rack 32 so that its left-hand end is free to be moved upwards by the spring, thus engaging the serrations 35 and 36 with one another.

As a result, the arm 37 and thereby the rocker assembly 7 is then held in the attained position, which is established on account of the shape of the shoe 1 and the bedding pressure exerted onto the presser members 14 and 15 at that stage. Under the effect of the following full pressure building up onto the cushion 5 and onto the end faces of the pads 20 to 23 as well as onto the support 4, the outsole 8 is then finally attached to the shoe 1.

As it concerns the processing of a shoe in which the outsole 8 is to be attached from the toe to the lower end of the breast of the heel 3, provision must be made so that an appropriate pressure can be exerted to the region of the breast of the heel 3. Support 4 and a heel support 40 provide this pressure. To prevent damaging heel 3, the support 40 has been provided with a pad 41. The heel support 40 is positioned on a lever 42, which is pivoted around a fulcrum 43 that extends transversely with respect to the longitudinal direction of shoe 1. By a rotary movement of the lever around its fulcrum 43 in direction towards the shoe 1, the pad 41 eventually abuts the heel 3. This extended position is outlined in FIG. 1 by dash-dotted lines. The horizontal swing movement of the lever 42 is indicated by the double-pointed arrow.

This horizontal swing movement of the lever 42 is effected in the following way: The cementing press is provided additonally with the heel abutment 44, which however, is not required as a support for the processing of shoe 1 illustrated in this context. Its supporting functions are described later in connection with the explanation of FIG. 2. In the case of FIG. 1, relevant, however, is the lifting mechanism for the heel abutment 44, consisting of a hydraulic piston 45 and a hydraulic cylinder 46, for the swinging movement of the lever 42. The heel abutment 44 is provided for this purpose with a fork 47 (of which, however, only one prong is drawn in FIG. 1 on account of the sectional view). Lever 42 is provided with an inclined slot 48 which extends between the two prongs of fork 47. The slots 48 engage a cylindrical pin 49 which is located in the two prongs of fork 47. When raising the heel abutment 44 and therefore also the fork 47, the pin 49 will naturally follow the same direction. Because of the inclined position of the slot 48, the pin 49 will force the lever 42 to swing around its fulcrum 43 in direction towards the shoe 1 until the pad 41 abuts finally the heel 3 and exerts the required pressure to the heel 3 in this area. As can be seen, the lifting mechanism for the heel abutment 44 is being used in order to give the required swinging movement to the heel support 40, so that it does not require a separate drive mechanism.

Figure 2:
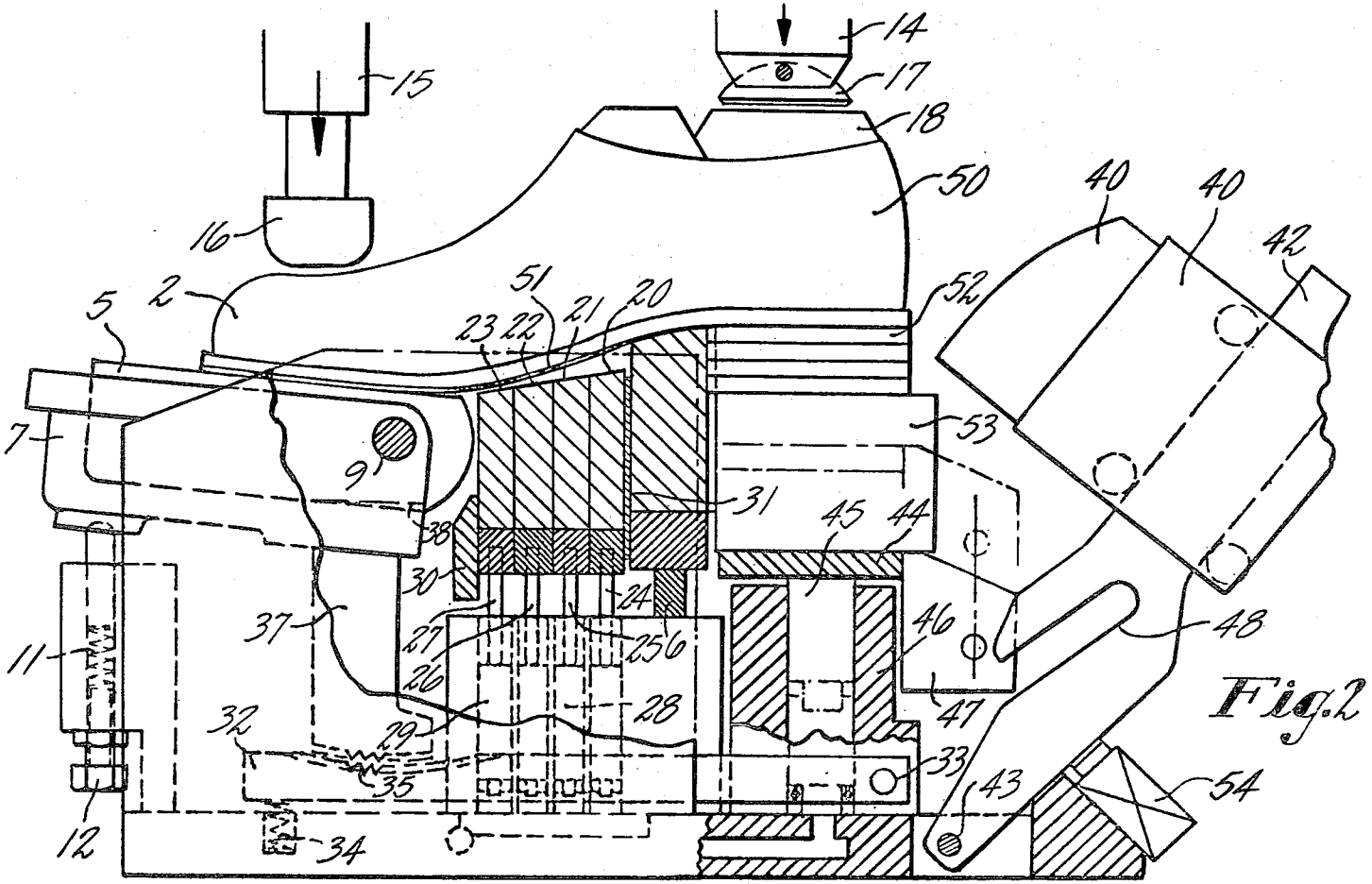
FIG. 2 shows the same cementing press without the catch and with a shoe, which heel is supported by a heel abutment.

FIG. 2 represents an operating sequence of the cementing press according to FIG. 1 in which a shoe 50 is to be processed. An outsole 51 extends over the whole of the shoe and not along the front of the heel. The shoe 50 is provided with a heel 52, which has to be particularly well-supported during the cement attaching process of the outsole 51. The attaching of the outsole 51 from the toe to the waist is effected according to the procedure described with reference to FIG. 1.

The support of the heel 52 is now provided by the heel abutment 44, upon which the cushion 53 is placed for this mode of operation. After raising the lifting mechanism for the heel abutment 44, the heel abutment together with a cushion 53 takes up the position as indicated by the dash-dotted lines, whereby the cushion 53 seats itself under the heel 52 and presses it upwards, thus effecting the desired cement attaching of the outsole 51 in this region. In these circumstances, the action effected by the heel support 40 is not required. Its function is prevented by withdrawing the pin 49 (see FIG. 1) from its location in the prongs of the fork 47, so that the upward and downward movement of the fork 47 can no longer influence the lever 42. The lever 42 can now tip back thus contacting the signaler 54 that is constructed as a microswitch because of the removal of the pin 49. When the microswitch gives a signal, the operating mechanism for the cementing press is changed over correspondingly.

The cementing press described in FIGS. 1 and 2 provides therefor, the facility to process the two different types of shoes illustrated, whereby a separate drive unit for the operation of lever 42 together with the heel support 40 need not be employed, as the drive effecting the swinging movement is being derived from the lifting mechanism for the heel abutment 44 that is necessary in any case.

Having thus described my invention, what I claim as new and desire to secure by Letters Patent of the United States is:

1. A cementing press for cement attaching outsoles to lasted footwear from their toe to the lower end of the heel breast by using a counter support applying pressure in the waist region, whereby a heel support takes up the pressure exerted to the heel breast during cement attaching, which heel support is arranged on a lever pivoted around a fulcrum running transversely to the longitudinal direction of the shoe towards the heel, thereby characterized, that the lifting mechanism for a heel abutment is provided with a catch which engages with an inclined slot in the lever, so that, with the lifting of the heel abutment the lever with the heel support is drawn up to the heel.

2. The cementing press according to claim 1, thereby characterized that the catch includes a cylindrical pin which is inserted transversely through a fork projecting from the lifting mechanism, in which said fork enters the lever together with the slot.

3. The cementing press according to claim 1 or 2, thereby characterized that the catch is used optionally and a signaler is provided, which is operated in the rearward position of the lever by withdrawing the catch for the purpose of changing over the cementing press.

* * * * *